US006406775B1

(12) United States Patent
Houde

(10) Patent No.: US 6,406,775 B1
(45) Date of Patent: Jun. 18, 2002

(54) MODIFIERS FOR OUTDOOR DURABLE INK JET MEDIA

(75) Inventor: Ajay Y. Houde, Brown Deer, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 09/351,554

(22) Filed: Jul. 12, 1999

(51) Int. Cl.[7] ..... B41M 5/00

(52) U.S. Cl. ..... 428/195; 428/211; 428/341; 428/342; 428/413; 428/474.4; 428/500; 347/165

(58) Field of Search ..... 428/195, 211, 428/341, 342, 413, 474.4, 500; 347/105

(56) References Cited

U.S. PATENT DOCUMENTS

| | | | | |
|---|---|---|---|---|
| 2,285,009 | A | 6/1942 | Brubaker et al. | 260/78 |
| 2,320,088 | A | 5/1943 | Leekley | 260/29 |
| 2,388,035 | A | 10/1945 | Frosch | 528/340 |
| 2,393,972 | A | 2/1946 | Cairns | 264/184 |
| 2,450,940 | A | 10/1948 | Cowan et al. | 564/138 |
| 2,596,200 | A | 5/1952 | Bestian | 548/964 |
| 3,157,681 | A | 11/1964 | Fischer | 562/509 |
| 3,165,675 | A | 1/1965 | Tesoro | 8/127.6 |
| 3,197,463 | A | 7/1965 | Tesoro et al. | 548/962 |
| 3,256,304 | A | 6/1966 | Fischer et al. | 560/127 |
| 3,258,443 | A | 6/1966 | Cantor et al. | 524/762 |
| 3,285,798 | A | 11/1966 | Tesoro | 442/149 |
| 3,338,885 | A | 8/1967 | Coker et al. | 548/968 |
| 3,380,844 | A | 4/1968 | Menikheim et al. | 428/516 |
| 3,394,029 | A | 7/1968 | MacArthur | 428/518 |
| 3,579,485 | A | 5/1971 | Folzenlogen et al. | 525/285 |
| 3,597,146 | A | 8/1971 | Tesoro | 8/115.7 |
| 3,637,550 | A | 1/1972 | Sprauer | 525/420 |
| 3,726,862 | A | 4/1973 | Coker et al. | 548/964 |
| 3,804,656 | A | 4/1974 | Kaliski et al. | 106/487 |

(List continued on next page.)

FOREIGN PATENT DOCUMENTS

| | | |
|---|---|---|
| EP | 0 409 440 | 1/1991 |
| EP | 0 529 797 | 3/1993 |
| EP | 0 704 560 | 3/1996 |
| EP | 0 732 218 | 9/1996 |
| GB | 1055676 | 1/1967 |
| GB | 1177199 | 1/1970 |
| WO | 97/15455 | 5/1997 |
| WO | 97/15456 | 5/1997 |

OTHER PUBLICATIONS

Chapter 2 of Oxidation Inhibition in Organic Materials (CRC Press, 1990, J, Pospicil et al., Eds. pp. 29–162) entitled "Photo–Oxidation of Polymers and its Inhibition", by Francois Gugumus.

Son, Pyong–Nae, *Modern Plastics Encyclopedia Handbook*, UV Stabilizers, pp. 119–120.

Wu, Souheng, *Polymer Interface and Adhesion*, Marcel Dekkar, Inc., p. 10.

*Primary Examiner*—Leszek Kiliman
(74) *Attorney, Agent, or Firm*—Whyte Hirschboeck Dudek SC

(57) ABSTRACT

Coating compositions for ink jet recording media are disclosed comprising at least one non-ionic surfactant, at least one dispersing agent, at least one ionomer, at least one polyamide binder, and at least one particulate filler. Optionally, the coating compositions may also comprise one or more of UV stabilizers, light stabilizers, and antioxidants. Furthermore, the compositions can also comprise a polyfunctional aziridine crosslinking agent. Also disclosed are ink jet recording media coated with the coating composition, methods for producing an ink jet recording media coated with the composition, and methods for improving weather resistance, curl resistance, dry abrasion resistance, wet abrasion resistance, and resistance to color density loss upon immersion in water by coating a substrate with the coating composition and allowing the coating composition to cure.

29 Claims, 5 Drawing Sheets

U.S. PATENT DOCUMENTS

| | | | | | |
|---|---|---|---|---|---|
| RE28,533 | E | | 8/1975 | Drawert et al. | 260/404.5 |
| 3,931,087 | A | | 1/1976 | Baatz et al. | 524/814 |
| 3,935,147 | A | | 1/1976 | Godshalk et al. | 524/251 |
| 3,948,668 | A | | 4/1976 | Hayek et al. | 106/31.59 |
| 3,959,174 | A | | 5/1976 | Winyall et al. | 423/338 |
| 4,012,560 | A | | 3/1977 | Baatz et al. | 428/475.2 |
| 4,014,645 | A | | 3/1977 | Chancler et al. | 8/495 |
| 4,070,421 | A | | 1/1978 | Etter, Jr. | 525/192 |
| 4,080,405 | A | | 3/1978 | Agouri et al. | 525/260 |
| 4,091,165 | A | | 5/1978 | Hayama | 428/409 |
| 4,097,677 | A | | 6/1978 | Emmons et al. | 560/220 |
| 4,175,969 | A | | 11/1979 | Mackey | 430/539 |
| 4,238,528 | A | | 12/1980 | Angelo et al. | 427/96 |
| 4,314,933 | A | | 2/1982 | Berner | 523/456 |
| 4,477,535 | A | | 10/1984 | Sinclair et al. | 428/476.3 |
| 4,563,307 | A | | 1/1986 | Briden | 548/964 |
| 4,571,267 | A | * | 2/1986 | Drawert | 106/31.43 |
| 4,609,704 | A | | 9/1986 | Hausman et al. | 524/710 |
| 4,619,705 | A | | 10/1986 | Dixon et al. | 106/487 |
| 4,619,956 | A | | 10/1986 | Susi | 524/87 |
| 4,722,868 | A | | 2/1988 | Pope | 428/480 |
| 4,735,627 | A | | 4/1988 | Nickel | 8/188 |
| 4,780,340 | A | | 10/1988 | Takahashi et al. | 427/393.5 |
| 4,791,165 | A | | 12/1988 | Bearss et al. | 524/516 |
| 4,818,325 | A | | 4/1989 | Hiraiwa et al. | 156/315 |
| 4,889,765 | A | | 12/1989 | Wallace | 442/71 |
| 4,938,951 | A | | 7/1990 | Leung et al. | 424/59 |
| 4,950,711 | A | | 8/1990 | Suwala | 524/819 |
| 5,045,864 | A | | 9/1991 | Light | 347/105 |
| 5,068,140 | A | | 11/1991 | Malhotra et al. | 428/216 |
| 5,084,340 | A | | 1/1992 | Light | 428/327 |
| 5,104,730 | A | | 4/1992 | Misuda et al. | 428/304.4 |
| 5,109,054 | A | * | 4/1992 | Smith | 524/514 |
| 5,154,760 | A | * | 10/1992 | Miller | 524/379 |
| 5,218,031 | A | | 6/1993 | Nayder et al. | 524/376 |
| 5,439,739 | A | * | 8/1995 | Furukawa | 428/341 |
| 5,570,120 | A | | 10/1996 | Sakaki et al. | 347/105 |
| 5,620,793 | A | | 4/1997 | Suzuki et al. | 428/342 |
| 5,688,603 | A | | 11/1997 | Iqbal et al. | 428/532 |
| 5,700,582 | A | | 12/1997 | Sargeant et al. | 420/476.6 |
| 5,707,722 | A | | 1/1998 | Iqbal et al. | 428/304.4 |

* cited by examiner

MODIFIERS FOR OUTDOOR DURABLE INK JET MEDIA

FIELD OF THE INVENTION

This invention relates to compositions that are useful as ink jet recording media topcoats, recording media for ink jet images, processes for making ink jet recording media, processes for recording images on ink jet recording media, and images made by such processes.

BACKGROUND OF THE INVENTION

Ink jet printers are a well known means for creating black and white or color images on a recording medium. The images are created by generating small droplets of ink which are propelled onto the recording medium. The ink generally contains a water-based dye or dispersed pigment and the recording medium is often paper, but may also be a coated polymeric film as in the case of transparencies for overhead projectors. Advantages with this type of printing include the ability to create high resolution full color images rapidly and in large formats using digitally generated and stored images. Furthermore, it is quiet and environmentally friendly and safe.

Ink jet printing is frequently used to produce graphics for outdoor applications. These outdoor applications require both the inks and the recording medium to be resistant to water, sunlight and extremes in temperature without sacrificing image quality. Recent advances in outdoor recording media include the use of water-insoluble polyamide topcoats to improve UV and water resistance of the recording medium.

However, the use of a topcoat tends to cause tension in the recording media which may result in the media curling. Additionally, the strength of the commercially available topcoats is limited by the internal bond strength of the coating. Likewise, improved abrasion resistance and color density are other desired characteristics of new ink jet media coatings. The present invention addresses these and other problems associated with prior art topcoat formulations.

SUMMARY OF THE INVENTION

In one embodiment, the invention is a coating composition for ink jet recording media, the coating composition comprising:

(a) At least one non-ionic surfactant;

(b) At least one dispersing agent;

(c) At least one ionomer;

(d) At least one polyamide binder, the polyamide binder having a surface energy of at least about 40 dyne/cm as measured by ASTM D2578-94; and (e) At least one particulate filler.

Yet another embodiment of this invention is a substrate coated with the inventive composition. A further embodiment is a method for increasing the weather resistance of ink-jet recorded images, the method comprising the steps of (i) applying the coating composition to a support material, and (ii) curing the coating material on the support material. Other embodiments are similar methods for increasing resistance to dry abrasion, increasing resistance to wet abrasion, increasing resistance to curl, and decreasing color density loss upon immersion in water.

The invention involves the use of ionomers, dispersing agents, and surfactants to produce ink jet coatings with hallmarks including, inter alia, superior resistance to water, high internal bond strength, scratch resistance, reduced tendency to curl, and increased color density.

DETAILED DESCRIPTION OF THE INVENTION

Figure 1:
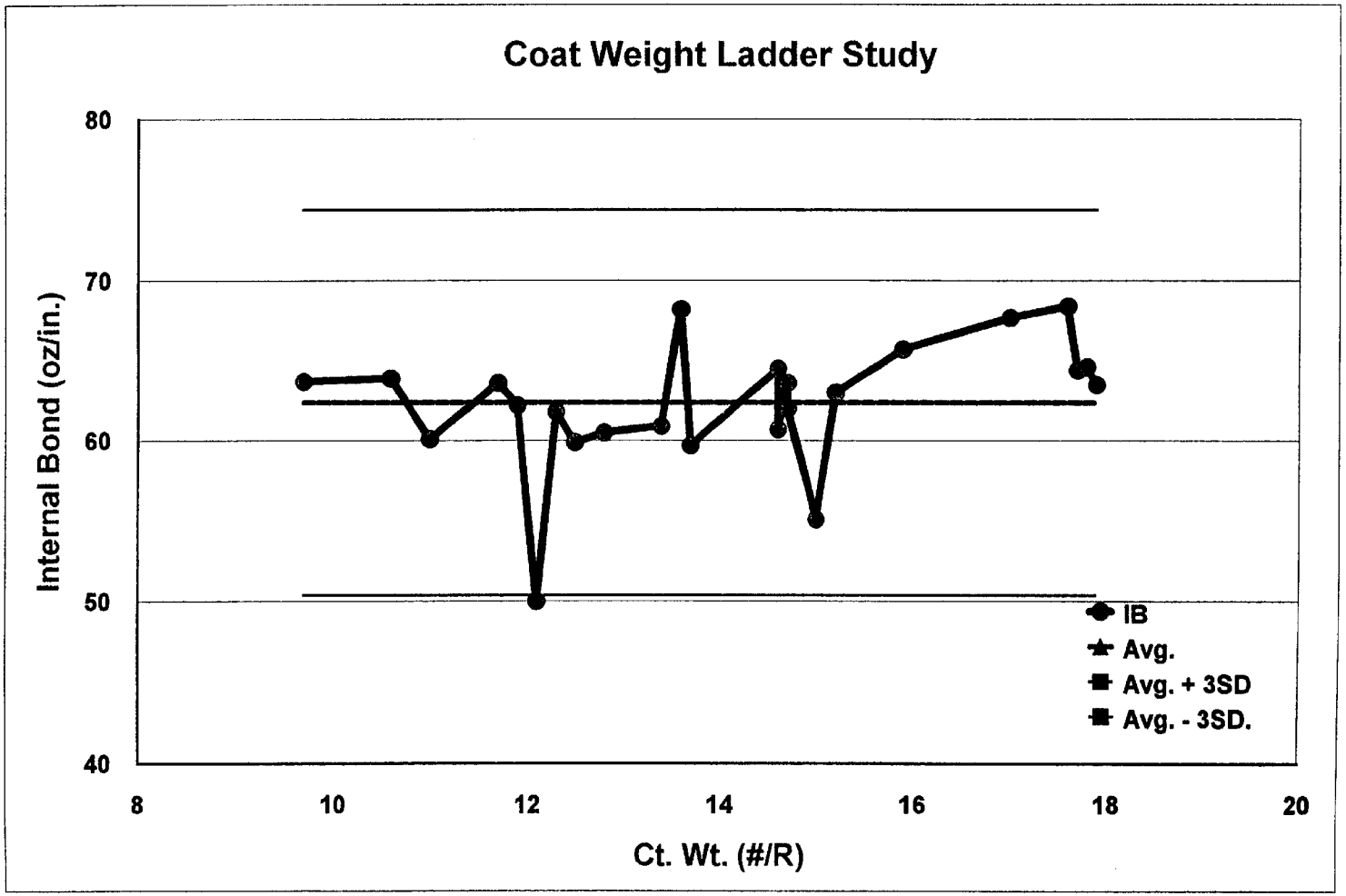
FIG. 1 is a graph showing the internal bond strength, as measured with a Thwing Albert EJA tensile tester, of different weight topcoats made with the coating composition of the current invention of an ink jet recording media topcoat made with the coating composition of this invention.

As used herein, the term "surfactant" means a surface active agent that modifies the surface tension of an aqueous or solvent-based solution.

The term "dispersing agent", herein, is a surface active agent added to a suspending medium to promote uniform and maximum separation of extremely fine solid particles.

A "surface active agent" or "surfactant", herein, is any compound that reduces surface tension when dissolved in water or water solutions, or which reduces interfacial tension between two liquids, or between a liquid and a solid. There are three categories of surface active agents: detergents, wetting agents, and emulsifiers; all use the same basic chemical mechanism and differ chiefly in the nature of the surfaces involved. The surface active agents can be non-ionic, cationic, or anionic, and could also be inorganic or organic/polymeric compounds.

"Ionomers", described herein, are a class of polymeric material, consisting of an organic backbone bearing a small proportion of ionizable functional groups. The organic backbones are typically hydrocarbon or fluorocarbon polymers and the ionizable functional groups are generally carboxylic or sulfonic acid groups. These functional groups, which reside on no more than about 10% of the monomer units in a polymer, may be neutralized, for example with sodium or zinc ions.

1. Non-Ionic Surfactant

Surfactants are molecules which have a hydrophobic (water repellant) moiety and a hydrophilic (having affinity to water) moiety. The hydrophilic end of the surfactant is attracted to the water molecules. In contrast, the force of attraction between the hydrophobic group and the water is only slight in comparison to the attraction between the hydrophilic group and the water. The hydrophilic groups give the primary classification to surfactants, and are anionic, cationic and non-ionic in nature. Anionic hydrophilic groups typically are the carboxylates (soaps), sulfates, sulfonates and phosphates. Cationic hydrophilic groups typically are some form of an amine product. Non-ionic hydrophilic groups do not contain components that ionize in water. Typically, the non-ionic hydrophiles are some form of a polyethylene glycol ether chain. These non-ionic hydrophilic groups associate with water at the ether oxygens of the polyethylene glycol chain. The surfactant of this invention is a non-ionic surfactant.

Preferably, the non-ionic surfactant of this invention is effective in both aqueous and solvent-based media. As discussed in more detail later, the coating composition may comprise a mixture of both aqueous and solvent-based systems. Examples of surfactants that are suitable for use in both aqueous and solvent-based media include fluorocarbon surfactants and silicon-based surfactants.

Preferably, the surfactant of this invention is a non-ionic fluorocarbon compound. Fluorocarbon surfactants help reduce the surface tension in both aqueous and solvent-based coatings. Fluorocarbon surfactants also have the advantage of facilitating control of the surface tension in organic systems during the application of a solvent-based coating and also during drying and resin cross-linking. Maintaining low surface tension values throughout the drying phase reduces surface tension gradients, which in turn helps reduce binder migration. Furthermore, it is believed that use of a non-ionic fluorocarbon surfactant to maintain surface tension during drying lowers the capillary force and also acts as a surface resistance to evaporation, thereby reducing stress induced curl.

The non-ionic fluorocarbon surfactant preferably is at least one of fluoroaliphatic polymeric ester, linear perfluorinated polyethoxylated alcohol, fluorinated alkyl polyoxyethylene alcohol or fluorinated alkyl alkoxylates. Preferably, the non-ionic fluorocarbon surfactant is a fluoroaliphatic polymeric ester with the structure shown in Formula I:

$$F(CF_2CF_2)_{2\text{-}10}(CH_2CH_2O)_{1\text{-}18}H \quad (I)$$

A preferred example of a fluorinated polymeric ester is a fluorinated alkyl ester, such as, FLUORAD® FC-430 (available from 3M®, St. Paul, Minn.).

Other examples of non-ionic fluorocarbons useful in this invention are disclosed in U.S. Pat. Nos. 5,707,722; 5,688,603; and 5,084,340, all of which are hereby incorporated by reference.

The non-ionic fluorocarbon surfactant is present in the coating composition in an amount greater than 0, preferably at least about 0.05, more preferably at least about 0.10, most preferably at least about 0.22 wt. %, preferably up to a level of about 1.0, more preferably up to about 0.40, most preferably up to about 0.27 wt. % , based on the weight of the total coating solution. The term "wt. %" is used herein to indicate weight percent. Mixtures of any of the above non-ionic surfactants are also usable in the present invention.

2. Dispersing Agent

Dispersing agents usable in this invention are polymeric electrolytes. Examples of suitable polymeric electrolytes are condensed sodium silicates, polyphosphates, and lignin derivatives. Additionally, in the non-aqueous media of some embodiments of this invention, compounds such as sterols, lecithin and fatty acids are effective dispersing agents.

In the present invention, the dispersing agent is preferably at least one of an inorganic material classified as an alkaline polyphosphate. Polyphosphates are a series of definite chemical compounds of high molecular weight containing one or more atoms of phosphorous. The polyphosphates are known for a high degree of dispersing and deflocculant power. Polyphosphates useful in this invention include tetrasodium pyrophosphate ($Na_4P_2O_7$) (TSPP), sodium hexametaphosphate $(NaPO_3)_6$, sodium tripolyphosphate ($Na_5P_3O_{10}$), disodium acid pyrophosphate ($Na_2H_2P_2O_7$), hexasodium tetrapolyphosphate ($Na_6P_4O_{13}$), tetrasodium pyrophosphate crystals ($Na_4P_2O_7 \cdot 10H_2O$), and tetrapotassium polyphosphate ($K_4P_2O_7$), preferably TSPP. Polyphosphate dispersing agents can be obtained from a number of sources, including, inter alia, FMC Corp., Crossfield Company, and the PQ Corporation.

The dispersing agent is present in the coating composition in an amount greater than 0, preferably at least about 0.01, more preferably, at least about 0.05, most preferably at least about 0.08 wt. %, up to about 1.0, preferably up to about 0.30, most preferably, up to about 0.12, wt. %, based on the dry particulate filler weight.

3. Ionomer

As stated earlier, ionomers have ionizable functional groups on an organic backbone. The presence of the ions in an otherwise organic matrix is not thermodynamically stable. As a result, these materials undergo a slight phase separation in which the ions cluster together in aggregates. These ionic clusters are quite stable and may contain several water molecules around each ion. These ionic clusters act partly as cross-links and partly as reinforcing filler, which is the reason for the greater mechanical strength that ionomers show.

The ionomer of the present invention can be cationic or anionic in nature. Cationic ionomers are preferred for use in the present invention because the majority of the ink jet printing inks are anionic in nature.

Preferably, the ionomer is a vinyl pyrrolidone copolymer. One preferred ionomer is a co-polymer of vinyl pyrrolidone and dimethylaminoethylmethacrylate quatrinized with diethyl sulfate (quatrinized VP/DMAEMA copolymer). More preferably, the ionomer is a vinyl pyrrolidone/methacrylaminopropyltrimethyl ammonium chloride co-polymer (VP/MAPTAC copolymer). These ionomers are sold under the trade names GAFQUAT 734 and GAFQUAT HS100, respectfully, and are available from International Speciality Products, Wayne, N.J.

Examples of other cationic ionomers that are usable in the present invention include cationic cellulose, cationic hydroxyethylcellulose, modified polystyrene, and cationic methacrylate polymer. Mixtures of any of the above-mentioned ionomers are also usable in the present invention.

The ionomer is present in the coating in an amount at least about 1, preferably at least about 5, and most preferably at least about 9, up to about 30, preferably up to about 15, most preferably up to about 11, wt. %, based on the dry weight of binder resin.

4. Binder Resin

The binder resins of this invention have surface energies greater than 40, preferably greater than 42, dyne/cm. As the surface energy of the coating increases, the spreading coefficient, which is defined by S. Wu, *Polymer Interface and Adhesion*, Marcel Dekker, 1982 as the decrease in free energy as the surface is covered with a film of liquid, increases. Physically this means that the rate of ink spread on the substrate increases. The inventors observed that the increase in coating surface energy manifests itself in color print density increases due to greater spread, or "dot gain", of the jetted ink droplets on the surface and increases in the rate of ink absorption as the ink spreads more rapidly into the capillaries of the porous coating. Swift ink absorption not only allows one to handle a print as soon as it comes off the printer, but for some wide-format ink jet printers the ink must dry within a few seconds or it will be smeared by handling or by rollers in the paper feed systems that may be only a few inches away from the printhead.

The surface energy of a flat film of binder resin is measured according to ASTM D2578-94. This test employs mixtures of formamide and ethyl CELLOSOLVE over the range of 30–56 dyne/cm. Test kits are available from Diversified Enterprises under the name ACCUDYNE Test Surface Tension Test Fluids.

(a) Alcohol-Soluble Binder Resins

In one preferred embodiment of this invention, the binder composition comprises a non-cationic alcohol-soluble water-insoluble binder resin dissolved in an alcoholic liquid medium. In this embodiment, the binder resin is preferably soluble to a concentration of at least 5 wt % in the alcohol or alcohol mixture used to prepare the recording media coating composition.

Alcoholic liquid medium has a boiling point less than 150 C, preferably less than 140 C, more preferably less than 120 C, and has a viscosity of up to 100 mPa·s, preferably up to 50 mPa·s. The alcohols are not a solvent for the polymeric support, although they may swell the support to some extent. Suitable alcohols include hydrocarbon compounds having at least one carbon atom and at least one hydroxyl group. They can have a wide range of carbon atoms and hydroxyl groups. Preferably, however, the alcohol has less than 15 carbon atoms and less than 4 hydroxyl groups. These alcohols may have other hereto atoms besides those contributed by the hydroxyl group(s) that are primary, secondary or tertiary to the hydrocarbon moiety as their valence allows so long as it does not become a solvent for the polymeric support.

Due to the polar nature of most binder resins, polar hydrocarbon liquids with hydroxyl groups are preferred alcoholic liquid media. Straight chain primary and secondary alcohols ranging from 1 to 6 carbon atoms in length, such as methanol, ethanol, propanol, n-butanol, 2-butanol, isopropanol, and so forth, are preferred. Tertiary alcohols such as diacetone alcohol are also appropriate. Glycol ethers such as diethylene glycol monobutyl ether, ethylene glycol monobutyl ether and propylene glycol monomethyl ether may also be included in the composition as alcoholic liquid media. The solvent composition of the coating composition may include up to 40 percent water and minor amounts of other organic solvents.

One preferred class of suitable alcohol-soluble binder resins are alcohol-soluble polyamides. Typical alcohol-soluble polyamides and methods of obtaining them are disclosed in U.S. Pat. Nos. 2,285,009; 2,320,088; 2,388,035; 2,393,972; 2,450,940 and 3,637,550, which are incorporated herein by reference. Preferred alcohol-soluble polyamides include alcohol-soluble melt-polymerized polyamides consisting essentially of recurring carboxamido groups and at least two different species of recurring hydrocarbylene groups selected from the group consisting of aliphatic and alicyclic groups of 2 to 40 carbon atoms as integral parts of the main polymer chain, and having at least 3 different recurring polyamide repeat units.

Preferred among such polyamides are those in which (a) about 33–100 mole percent of the imine groups are derived from polymethylene diamine of 6 to 20 carbons, (b) about 5–65 mole percent of the carbonyl groups are derived from dimerized fatty acids of 16 to 48 carbon atoms, (c) about 8–65 mole percent of the carbonyl groups are derived from polymethylene diacid of 6 to 18 carbon atoms, and (d) about 8–65 mole percent of the carbonyl groups are derived from monomer selected from the group consisting of (1) polymethylene diacid of 6 to 18 carbon atoms which is different from diacid (c), and (2) polymethylene omega-aminoacid of 6 to 18 carbon atoms. These polyamides have an annealed heat of fusion of about 5 to 18 calories per gram, are quenchable to the amorphous state at a cooling rate of about 100 C per minute, and have an upper glass transition temperature in the amorphous state of less than about 30 C.

A particularly preferred class of polyamides includes those in which (1) about 98–100 mole percent of the imine groups are derived from hexamethylene diamine, (b) about 15–55, and preferably 25–55, mole percent of the carbonyl groups are derived from dimerized fatty acid of 36 carbon atoms, (c) about 10–45, and preferably 15–45, mole percent of the carbonyl groups are derived from adipic acid, and (d) about 15–55, and preferably 15–45, mole percent of the carbonyl groups are derived from polymethylene diacid of 10 to 12 carbon atoms. Most preferably, these polyamides have a minimum flow temperature of about 160 to 210 C.

Suitable polymethylene diamines for preparing suitable polyamides include hexamethylene diamine, heptamethylene diamine, octamethylene diamine, nonamethylene diamine, decamethylene diamine, undecamethylene diamine, dodecamethylene diamine, tridecamethylene diamine, and octadecamethylene diamines. Suitable polymethylene diacids for preparing suitable polyamides include adipic, pimelic, suberic, azelaic, sebacic, dodecanedioic, brassylic, tetradecandioic and octadecanedioic acids. Suitable aminoacids include 6-aminocaproic, 7-aminoheptanoic, 8-aminocaprylic, 9-aminononanoic, 10-aminodecanoic, 11-aminoundecanoic, 17-aminoheptadecanoic, and the like.

By "dimerized fatty acid of 16 to 48 carbons" is meant dimers derived from fatty acids of 8 to 24 carbons. These dimerized fatty acids are commercially available materials which have been fully described in the literature including U.S. Pat. No. 3,157,681 and 3,256,304, which are incorporated herein by reference. These dimerized fatty acids are obtained by catalytic or non-catalytic polymerization of ethylenically unsaturated fatty acids.

The method of forming polyamides by melt-condensation is well known to those skilled in the art. This polymerization reaction is described, for example, in U.S. Pat. Nos. 2,252,554 and 2,285,009, which are incorporated herein by reference and British Patent 1,055,676. The reaction is carried out by heating diacids and diamines, or their polyamide-forming derivatives, and, if desired, amino acids or their polyamide-forming derivatives at temperatures of about 150 to 300 C while driving off water, and continuing the reaction until the desired molecular weight is obtained. The resulting polyamide will contain substantially equimolar amounts of carbonyl groups and imine groups. The polymer end groups will be carboxylic acid and amine, one of which may be in slight excess depending upon which reactant was present in excess. In accordance with this invention there should be at least as many amine ends as carboxyl ends.

These polyamides and how to make them are described in more detail in U.S. Pat. No. 3,637,550, which is incorporated herein by reference. Specific examples of this type of polyamide that are useful in this invention include ELVAMIDE nylon terpolymer resins (E. I. DuPont de Nemours, Inc., Wilmington, Del.), GENTAL nylon terpolymer solutions (General Plastics Corp., Bloomfield, N.J.) and ARROCHEM NR 0923 and NR 1063 nylon terpolymer solutions (Arrochem, Inc., Mt. Holly, S.C.). Particularly preferred binder resins are solutions of ELVAMIDE 8063 nylon terpolymer in blends of low molecular weight aliphatic alcohols and water, especially those available under the trade name GENTAL (General Plastics Corp).

Also included as preferred alcohol-soluble polyamides are those prepared by condensing a monocarboxylic acid, diamine and dimerized fatty acid, described in further detail in U.S. Pat. No. Re. 28,533, those prepared by condensing an acid component of dimerized fatty acids, at least one aliphatic unbranched monocarboxylic acid and at least one aliphatic branched monocarboxylic acid with ethylene diamine and hexamethylene diamine as the amine component described in further detail in U.S. Pat. No. 4,571,267, and those polyamide resin compositions that comprise the condensation reaction product of a $C_{36}$ dimerized fatty acid, at least one dibasic acid, at least one $C_1$–$C_4$ alkyl diamine and at least one piperazine-like diamine, the equivalents of amine groups being substantially equal to the equivalents of carboxyl groups, where 30 to 50 equivalent percent of the carboxyl groups are contributed by the dibasic acid component and 73 to 93 equivalent percent of the amine groups are contributed by the piperazine-like diamine component described in further detail in U.S. Pat. No. 5,154,760. Each of these U.S. Patents are incorporated herein by reference for their relevant description. Specific examples of this type of polyamide resin include the UNI-REZ fatty acid dimer-based polyamides (Union Camp Corp., Wayne, N.J.).

(b) Dispersed Binder Resins

In another preferred embodiment of this invention, the binder resin composition is a dispersion of a non-cationic water-insoluble binder resin in an aqueous or alcoholic liquid medium. The alcoholic medium may be selected from among those described above as solvents for the resins which are soluble in alcoholic liquid media. The aqueous or alcoholic medium may be a mixture of an alcoholic medium with an aqueous media, and it may further comprise minor amounts of non-alcoholic organic solvents.

In one preferred embodiment, the binder resin is an aqueous dispersion of a non-cationic water-insoluble polyamide. Aqueous polyamide dispersions that are useful in this invention include GENTON nylon terpolymer dispersions (General Plastics Corp.) and MICROMID fatty acid dimer-based polyamide dispersions (Union Camp Corp.).

Polyamides suitable for making aqueous dispersions include polymerized fatty acid polyamide resins which have been prepared so as to have a low acid and low amine number. The dispersion is typically prepared by heating the polyamide resin to a temperature at or above its melting point. The liquefied polymerized fatty acid polyamide resin is then blended with a predetermined amount of water which is heated to a temperature such that the resulting blend will have a temperature above the melting point of the polyamide resin. A surfactant, which may be anionic, non-ionic or cationic, preferably non-ionic, and which will promote the emulsification of the polyamide resin in water, is included in the mixture. The resulting mixture is then subjected to sufficient comminuting forces to form an emulsion in which droplets of the polyamide resin have an average diameter particle size of about 20 microns or less and preferably 5 microns or less. The resulting emulsion is then cooled to a temperature below the melting point of the polyamide resin causing the emulsified droplets of the polyamide resin to solidify as finely divided particles which are dispersed uniformly through the aqueous phase. The resulting stable aqueous dispersions of the polymerized fatty acid polyamide resin are obtained. This type of binder resin composition is described in more detail in U.S. Pat. No. 5,109,054, which is incorporated herein by reference.

5. Particulate filler

In this invention, the polymeric binder resins do not absorb a significant quantity of water, as water-resistance is one objective. Consequently, particulate fillers with extensive pore structures are added to create porosity in the coating and capacity for holding the water and water-miscible components present in the ink. Suitable particulate fillers are well-known in the art. Typically, the particulate fillers are pigment particles.

If pigment particles are systematically added to a binder, eventually a point is reached at which there is no longer enough binder to fill all of the space between the pigment particles. This is the critical pigment volume concentration, CPVC (ref. —T. C. Patton, *Paint Flow and Pigment Dispersion*, *2nd ed.*, Wiley-Interscience, 1979), a key quantity well known to those skilled in the art. As the pigment-:binder ratio increases above the CPVC, the amount of void space in the coating increases. Thus, the coating must be above the CPVC in order to be absorptive if the binder is non-absorptive. The pigment particle to binder resin ratio in the coating compositions of this invention is in the range from 0.5:1 to 3:1, preferably from 0.8:1 to 2:1.

The main restriction upon pigments for this invention is that they have a large absorption capacity, as is commonly defined by their oil absorption value. It is preferred that the pigment have an oil absorption value greater than 60, such as greater than 150, more preferably greater than 250, and even more preferably greater than 300, g oil/100 g pigment particles. In a preferred embodiment, the oil absorption value correlates to a specific pore volume of at least 0.5, more preferably at least 1.0, even more preferably at least 1.5, cc/g. Generally, the higher the oil absorption, the more preferred the pigment. The method for measuring the oil absorption value is set forth in ASTM D281-31.

There are no other specific limitations on the pigment or other absorptive material employed in this invention. The use of many different absorptive inorganic pigments may be found in the paper coating literature. These materials include calcium carbonate, precipitated silica, fumed silica, silica gel, titanium dioxide, talc, alumina, boehmite, pseudo-boehmite (U.S. Pat. No. 5,104,730), aluminum hydroxide, basic magnesium carbonate, amorphous magnesium carbonate, polyaluminum chloride, and zinc oxide. Sol-gel coatings obtained by hydrolysis of alkoxides of silicon or aluminum are another class of materials suitable for use in this invention. Preferred materials are sometimes referred to as "flatting agents."

The preferred pigment in this invention is silica. Preferably, the silica has an average particle size at least about 5 microns up to about 16 microns. Most preferably, the silica has an average particle size of 12 microns. Examples of preferred pigments include GASIL HP220, HP39, and IJ45 (Crosfield Co., Joliet Ill.), and SYLOID C812, W500, 620, and LV-6 (W. R. Grace & Co. —Conn., Baltimore, Md.). A particularly preferred pigment is SYLOID C812, which has an oil absorption value of 320 g oil /100 g pigment particles and an average particle size of 12 microns. In general, silicas with large particle size and narrow particle size distribution give coatings with more interparticle void space and better ink absorption.

A method for selectively producing high pore volume silica gel described in U.S. Pat. No. 3,959,174, which is incorporated herein by reference for its relevant disclosure, may be used to make hydrophilic pigment particles that are useful in practicing this invention. It describes a process for selectively producing a silica having a specific pore volume within the range of 1.2 to 3.0 cc/g using alkaline gelation, by the control of silicate concentration, the use of a desolubilizing substance such as ammonium hydroxide, sodium sulfate or other such salt to decrease the solubility of silica, and the concentration ratio of this desolubilizing agent to silica content. The silica concentration is maintained at 3 to 15 percent, the silica to desolubilizing agent ratio at 2 to 20 and the gelation pH at 10.6 to 11.2. The gelled silica is then aged, neutralized, filtered, optionally aged a second time and washed. For this invention, the preferred values are in the range from 8 to 12 percent, more preferably 10 percent, Si02 and the $SiO_2/NH_3$ ratio in the range from 4 to 8, more preferably 6. After washing and filtering and prior to reslurrying, the silica is dried. This may be oven drying or spray drying. This drying forms particle agglomerates of greater than 25 microns. The agglomerated silica is fed into a fluid energy mill, preferably of the micronizer or jet pulverizer type. When the particles are at a predetermined size within the range of about 1 to 25 microns, they exit from the mill and are collected.

6. Topcoat Additives

Optionally, additives may be added to the topcoat formulation to provide additional beneficial properties. Additional properties may be particularly preferred when the image-bearing recording media is exposed to environmental conditions that are deleterious to the integrity of the image.

One of those environmental conditions is exposure to short wavelength radiation, such as the ultraviolet radiation contained in sunlight. Ultraviolet radiation is known to cause photochemical damage to coatings and color images, such as structural damage and fading or darkening of colors. Optional additives which are known to protect against degradation by ultraviolet radiation are generally classified as UV absorbers, light stabilizers, and antioxidants.

Examples of UV absorbers include compounds classified as derivatives of hydroxybenzotriazole, hydroxybenzophenone, and triazines, such as hydroxyphenel-s-triazines. Specific examples include TINUVIN™ 1130 from Ciba Geigy (a mixture of poly(oxy-1,2 ethanediyl), α-(3-(3-(2H-benzotriazol-2-yl)-5-(1,1-dimethylethyl)-4-hydroxyphenyl)-1-oxopropyl)-ω-hydoxy and poly(oxy-1,2 ethanediyl), α-(3-(3-(2H-benzotriazol-2-yl)-5-(1,1-dimethylethyl)-4-hydroxyphenyl)- 1-oxopropyl)-ω-(3-(3-(2H-benzotriazol-2-yl)-5-(1,1-dimenthylethyl)-4-hydroxyphenyl)-1-oxopropoxy); CYASORB™ UV 24 from Cytec (a hydroxybenzophenone UV absorber); and CYASORB™ UV1164 also from Cytec (a UV absorber of the substituted s-triazine class).

The UV stabilizers are typically hindered amine light stabilizers (HALS). Specific examples include TINUVIN™ 292 and 770 and CHIMASSORB™ 944FL, all from Ciba Geigy.

The antioxidants which are useful, as optional additives, in the topcoat formulations of the present invention may be selected from a wide range of compounds, such as the phenolic antioxidants, e.g., hindered monophenols, diphenols, and polyphenols, and phosphites and phosphonites. Examples of the phenolic antioxidants include the IRGANOX™ series from Ciba Geigy, such as IRGANOX™ 1098, and an example of the phosphite type antioxidant is ETHANOX™ 398 from Ethyl Corporation.

Further examples of UV absorbers, stabilizers and antioxidants that may be used as additives to the topcoat compositions according to this invention may be found in Chapter 2 of *Oxidation Inhibition in Organic Materials* (CRC Press, 1990, J. Pospicil et al., eds., pp. 29–162), entitled "Photo-oxidation of Polymers and its Inhibition" by Francois Gugumus; *Modern Plastics Encyclopedia Handbook* (McGraw Hill, 1994); "UV Stabilizer" by Pyong-Nae Son, pp. 119–120; European Patent Application 704,560, and U.S. Pat. Nos. 4,314,933 and 4,619,956, the U.S. patents of which are incorporated herein by reference.

Polyamide-based topcoats, when UV-stabilized with an additive package, have proven especially suitable for applications requiring outdoor weatherability in which a high degree of water-resistance is required. Additives appropriate to polyamides include hydroxybenzophenone and hydroxybenzotriazole UV absorbers, hindered amine light stabilizers, and phenolic and phosphite antioxidants. Best results are usually obtained when a combination of UV absorbers, hindered amines, and antioxidants are used.

An advantage of ink jet media with the polyamide-based topcoats of this invention relative to the prior art is that no overlamination, heating, exposure to UV light or an electron beam, or other post-treatment is required after printing. The polyamides may be coated either from solution in alcohols and alcohol/water mixtures or in the form of aqueous dispersions.

7. Polyfunctional Aziridine

In a preferred optional embodiment, this invention uses a polyfunctional aziridine to crosslink with the binder. Crosslinking the binder improves abrasion and weather resistance.

The term "crosslinking" refers to the attachment of two chains of polymer molecules, or two sections of the same polymer molecule, by bridges, composed of either an element, a group, or a compound, which joins certain carbon atoms of the chains by primary chemical bonds. A "crosslinking agent" is the element, group, or compound that forms such a bridge between two chains of polymer molecules. As used herein "crosslinker" has the same meaning as "crosslinking agent."

Polyfunctional aziridines contain multiple aziridine groups. Any aziridine containing at least two, preferably at least three, aziridine groups can be used as the crosslinking agent in this invention. Suitable aziridines have the general formula (I):

$$R—Z_n \quad (I)$$

where R is any organic radical, Z is an aziridine ring, and n is at least 2, preferably at least 3. Commercially available polyfunctional aziridines are generally trifunctional in character, and frequently are reaction products of ethylene imine or propylene imine with pentaerythritol triacrylate.

Such polyfunctional aziridines are described in the following U.S. Pat. Nos.: 2,596,200; 3,165,375; 3,197,463; 3,285,798; 3,338,885; 3,597,146; and 3,726,862 incorporated herein by reference. Other known polyfunctional aziridines that can be used in this invention are aziridine derivatives of acrylates of alkoxylated polyols having a degree of alkoxylation of from about 2 to about 12, such as those described in U.S. Pat. No. 4,563,307, incorporated herein by reference. Specific examples of suitable polyfunctional aziridines include trimethylolpropane-tris-(β-(aziridinyl) propionate), pentaerythritol-tris-(β-(aziridinyl)propionate), and trimethylolpropane-tris-(β-(N-methylaziridinyl) propionate), preferably trimethylolpropane-tris-(β-(aziridinyl)propionate) or pentaerythritol-tris-(β-(aziridinyl) propionate).

Each aziridine group can react with a polar group such as those listed below in either the coating or on the substrate. Increased temperature, or the protonation of the nitrogen's pair of electrons, causes the aziridine ring to become activated. The activated aziridine ring can then be attacked by a nucleophile resin which causes the aziridine ring to open and form a strong covalent chemical bond with the nucleophile resin. This can happen for each aziridine group to form a completely crosslinked system. The reactive polyfunctional aziridine molecule is completely incorporated in the coating with no leaching or out-gassing.

Polyfunctional aziridines are known to react with groups containing a reactive hydrogen. Typical reactive groups include carboxylic acids, hydroxyls, amines, and thiols. The nitrogen bonded hydrogens of the amide moieties, as well as the acid end groups of the polyamides, are sufficiently active to react with the crosslinkers under mild conditions. Although polyfunctional aziridines have been used as crosslinking agents in ink jet media coatings before, such use typically was with binders with hydroxyl groups. Crosslinking non-hydroxyl binders with polyfunctional aziridines produces a coating for an ink jet recording media that has both good UV and weather resistance while maintaining the quality of the image. Furthermore, while other crosslinking agents, such as organotitanates and zinc ammonium carbonate, provide the adhesion benefits of the current invention, they typically do not provide the required weather resistance. The weather resistance of polyamide binders crosslinked with either organotitanates or zinc ammonium carbonate generally is worse than without such crosslinkers.

There are several companies which supply polyfunctional aziridines for crosslinking coatings. Sybron Chemicals, Inc., sells trimethylolpropane-tris-(β-(aziridinyl)propionate) under the trade name PFAZ-322. EIT, Inc., sells the same additive as XAMA-2 as well as pentaerythritol-tris-(β-(aziridinyl)propionate) as XAMA-7.

The polyfunctional aziridine is present in an amount above 0, more preferably at least about 5, and most preferably at least about 9, up to 50, preferably up to about 30, more preferably up to about 20, and most preferably up to about 11, wt % based on the weight of the binder resin.

8. Supports

The coating compositions of this invention can be used on a variety of supports, including paper, polymer-coated paper, synthetic paper, vinyl (such as cast vinyl or calendared vinyl), polyethylene, polypropylene, polyester (such as polyethylene terephthalate), polystyrene, etc. The advantages of this invention are particularly pronounced with regard to supports having low surface energy, low porosity and/or a generally poor ability to absorb and adhere to ink jet inks. Supports that have good weatherability are preferred in those applications in which weatherability is a criterion.

The surface of a low surface energy support such as nearly any of the commercially manufactured polymer supports mentioned above, is often treated to raise its surface energy and provide polar groups which can hydrogen bond to attain good adhesion between the support and the binder. To render these support materials improved in adhesiveness, surface treating methods are known which comprise subjecting the substrates to flame treatment, corona discharge treatment, irradiation treatment or oxidizing treatment with a bichromate, sulfate or the like so as to produce polar groups such as a carbonyl group on the surface of the substrates. However, such treatments need special equipment and are complicated to carry out.

Another approach is to coat the support with a primer which comprises a polar polymer having a surface energy intermediate between that of the support and that of the coating composition. Acrylic polymers, polyurethane polymers and mixtures of acrylic and polyurethane polymers are preferred, particularly when they are in the form of an aqueous dispersion. A primer may be applied at low coat weights, such as in the range of 1 to 4 g/m$^2$ dry weight.

It is also known to employ certain chlorinated polymers as primers to enhance the bonding of materials to untreated polyolefin surfaces. Chlorinated mixtures of a hydrocarbon resin and polyethylene are taught in U.S. Pat. No. 4,070,421 for use as primers and paint and ink additives for improving adhesion of coatings to polyolefin. Chlorinating carboxyl-group-containing polyolefins to form primer coatings for untreated polyolefin substrates is taught in U.S. Pat. No. 3,579,485. U.S. Pat. No. 3,380,844 teaches the coating of polyolefin film by a polymer of vinylidene chloride, a (meth)acrylate ester and (meth)acrylic or itaconic acid. All the foregoing patents are incorporated herein by reference for their relevant disclosures.

Polymers other than chlorinated polymers have also been adhered to polyolefins. U.S. Pat. No. 4,080,405 teaches a process for chemical modification of polyolefins by grafting polar monomers onto the polyolefin by means of a free radical generating material to produce a polyolefin surface having improved wetability. U.S. Pat. No. 3,394,029 teaches the coating of polyolefin surfaces by polymers of certain terpene acrylates and N-terpene acrylamides for improved adhesion of conventional lacquer topcoats. U.S. Pat. No. 4,014,645 teaches the enhancement of dye receptivity of polyolefin materials used in fabric manufacture by coating the polyolefin with a self-curing polymeric binder containing a quaternary ammonium salt. U.S.

Pat. No. 4,097,677 discloses certain radiation curable coatings, useful to coat some polyolefins;

the coatings comprising monomeric unsaturated esters of glycol monodicyclopentenyl ethers. In British Patent 1,177,199, non-woven webs are disclosed containing a major amount of polypropylene fibers bonded with binder comprising vinyl acetate, ethylene and an unsaturated N-methylol amide or an alkyl ether thereof. U.S. Pat. No. 3,258,443 describes a latex which may be used to deposit a pressure-sensitive adhesive on polyethylene and polypropylene. The latex is prepared from 1 to 45% vinyl acetate, 50 to 98% of an alkyl acrylate having an alkyl group of between 4 and 10 carbon atoms (several acyclic alkyl groups are named) and 1 to 5% of an unsaturated carboxylic acid. Two patents to Baatz et al., U.S. Pat. Nos. 3,931,087 and 4,012,560, teach the use of copolymers of a sulfonic acid and esters of acrylic or methacrylic acids as pressure sensitive adhesives which are adherent to a number of surfaces including polyethylene and polypropylene. Each of the foregoing United States patents is incorporated herein by reference.

U.S. Pat. No. 4,818,325, incorporated herein by reference, describes a useful primer which comprises at least one organometallic compound and at least one organic polymer and is used in bonding non-polar or highly crystalline resin substrates together or bonding another material to the resin substrate with the use of a 2-cyanoacrylate.

Polyurethane resins may also be used as primers. The polyurethane resins include thermoplastic polyurethane resins and thermosetting polyurethane resins. In addition, the polyurethane resins include modified polyurethane resins as far as it mainly comprises polyurethane resins. However, in order to give a high adhesive capacity and a high elasticity to a paint film, thermoplastic polyurethane resins having a mean molecular weight (Mn) of 2,000 to 10,000, preferably 4,000 to 7,000, are used. Such resins are described in U.S. Pat. No. 4,780,340 for making additional primers.

The invention is described in more detail in the following examples.

EXAMPLES

Example 1

This example of the invention shows the preparation of an outdoor weatherable coated vinyl as an ink jet printable substrate. In order to improve the adhesion of the coating to the vinyl substrate, a primer coat is employed as shown in Table I.

A. Substrate Preparation

TABLE I

| Primer Formulation A: | |
|---|---|
| Component | Weight (g) |
| JONCRYL 617 | 50 |
| NEOREZ R-972 | 50 |

JONCRYL 617 is a S. C. Johnson and Co. trademark for a styrenated acrylic latex.
NEOREZ R-972 is a trademark of the Bayer Co. for a colloidal, aqueous dispersion of an aliphatic polyurethane.

A calendered white vinyl substrate with a polymeric, non-migratory plasticizer available from Intex Plastics Corporation coated with a pressure sensitive adhesive and mounted on a paper liner is coated with Primer Formulation A using a #5 wire wound rod and dried in a forced air oven at 38 C for 1 minute.

B. Coating Preparation

A stock formulation, shown in Table II, with an alcohol-soluble, water-insoluble polyamide is made according to the procedure detailed below:

TABLE II

| STOCK SOLUTION FORMULA | | |
|---|---|---|
| Component | Function | Weight (g) |
| ELVAMIDE 8063 solution (26% in 20:80 water/methanol blend) | binder in solution | 815.2 |
| SYLOID C812 | pigment particle | 212.0 |
| methanol | solvent | 636.0 |
| deionized water | solvent | 212.0 |
| TINUVIN 1130 | UV absorber | 8.7 |
| TIVNUVIN 770 | light stabilizer | 8.7 |
| IRGANOX 1098 | antioxidant | 5.2 |
| n-butanol | solvent | 6.2 |

ELVAMIDE is a trademark of E. I. DuPont de Nemours, Inc. for an alcohol-water soluble nylon terpolymer resin.
SYLOID C812 is a trademark of W. R. Grace & Co. - Conn. for a specific silica gel.
TINUVIN 1130 is a trademark of Ciba-Geigy Corp. for a substituted hydoxyphenyl benzotriazole UV absorber.
TINUVIN 770 is a trademark of Ciba-Geigy Corp. for a hindered amine light stabilizer
IRGANOX 1098 is a trademark of Ciba-Geigy Corp. for a high molecular weight, polyfunctional, nitrogen-containing, hindered phenolic antioxidant.

SYLOID C812 silica is dispersed in the methanol and deionized water with a high-speed mixer. ELVAMIDE polyamide solution (212 g ELVAMIDE 8063, 120.6 g water, 482.6 g methanol) is then added and the components were mixed until homogenized. A UV stabilization package consisting of a benzotriazole UV absorber (TINUVIN 1130), hindered amine light stabilizer (TINUVIN 770), and a phenolic antioxidant (IRGANOX 1098) is dissolved in the n-butanol and subsequently added and stirred in. Generally, it is known in the art that UV stabilization additive packages containing UV absorbers, hindered amines, and antioxidants in combination give much better resistance to radiation damage than any of those components employed singly.

Additional batches of stock are made as needed.

C. Test Sample Preparation

Various ingredients are added to about 960 gram portions of this stock as shown in Table III. The mixtures are allowed to stir for one hour prior to coating. Increasing the mixing time up to a total of about one hour results in improved performance of the coating in regard to cohesion and weather resistance. Mixing times over about one hour do not result in any further performance improvement of the coating in regard to cohesion or weather resistance.

TABLE III

| | | Test Sample Formulas | | | | |
|---|---|---|---|---|---|---|
| Compound | Function | A Control (g) | B x/ XAMA (g) | C w/ $NaHCO_3$ (g) | D New Ctg (g) | E New + XAMA (g) |
| Stock Solution (Table II) | | 960.4 | 960.4 | 960.4 | 960.4 | 960.4 |
| XAMA-7[1] | Cross-linker | 0.0 | 9.6 | 0.0 | 0.0 | 9.6 |
| Sodium Bicarbonate | Buffer | 0.0 | 0.0 | 4.8 | 0.0 | 0.0 |
| GAFQUAT HS 100[2] | Ionomer | 0.0 | 0.0 | 0.0 | 96.1 | 96.1 |
| FLUORAD FC-430[3] | Surfactant | 0.0 | 0.0 | 0.0 | 2.4 | 2.4 |
| Tetrasodium Pyrophosphate | Dispersing Agent | 0.0 | 0.0 | 0.0 | 0.21 | 0.21 |
| Total | | 960.4 | 970.0 | 965.2 | 1059.1 | 1068.7 |

[1]XAMA-7 is a trademark for pentaerythritol-trio-(β-(aziridinyl) propionate) sold by EIT, Inc. of Lake Wylie, South Carolina
[2]GAFQUAT HS100 is a trademark for vinylpyrrolidine/methacrylamidopropyltrimethyl ammoniumchloride copolymer [CAS No. 131954-48-8]
[3]FLUORAD FC-430 is a trademark for fluoroaliphatic polymeric esters available from 3M ®, St. Paul. MN.

A range of Meyer bars is used to coat each formulation onto the primed, white, pressure sensitive vinyl prepared in step A. Meyer bars, also known as wire wound rods, are metal bars wrapped with a wire coil such that the wire is in continuous contact with the bar and with the adjacent wire loops. The substrates are coated by applying an excess of coating to the substrate and drawing the Meyer bars across the surface of the substrate to spread the coating evenly over the substrate surface and to remove the excess coating. The resulting thickness of the coating is a function of the wire size of the Meyer bar. The correlation is such that a No. 60 Meyer bar applies an about 6 mil thick wet coat while a No. 10 Meyer bar applies an about 1 mil thick wet coat.

After air drying for 24 hours each sample is printed on a COLORPIX™ 36" wide printer (a wide format ink jet printer available from Brady Worldwide, Inc.) using the system's pigmented outdoor ink. The pigmented ink is available from Fuji Photo Film Co., Ltd. and has the following catalog numbers: CPP ink PG Y (yellow); CPP ink PG C (cyan); CPP ink PG M (magenta); CPP ink PG K (black). The same inks are available as a set from Brady Worldwide, Inc. as part no. 16021 (combo). Densities (CMYK) are read with a MacBeth Color Checker RD-1255 densitometer.

D. Test Results

1. Cohesion

Cohesion of the coatings is measured by laminating an EXCELAR® 1000 pressure-sensitive film (available from Brady Worldwide, Inc.) onto the coating and measuring the force required to remove it with a Thwing Albert EJA tensile tester. All failure is cohesive, i.e., the intra-coating cohesion fails before the adhesion between the coating and the substrate fails. Therefore, the cohesion tests measure the strength of the internal bond of the topcoat rather than the bond between the topcoat and the substrate. As such, all cohesion test results will be referred to as internal bond values. The results are reported in Table IV.

The dispersing agent appears to reduce the binder migration during drying process. As a result, the internal bond values of the topcoat of the current invention does not change even with significant (~40%) variation in coat weight. FIG. 1 shows stable internal bond strength for a topcoat, made of Formulation D, applied in a range of 10–18 #/R, where #/R designates the weight of the coating (in pounds) per ream (3000 $ft^2$) of substrate. It is also possible that the ionomer is strongly attached to the surface of the silica and thereby improves the bonding of the polyamide to the pigment. Also, slight variations in the coat weight (up to +/−0.5 #/R) have very minimal or no effect on color density. The ability to increase the topcoat weight without affecting the critical properties provides another variable to increase the absorption capacity which is a surprising advance over prior art topcoats.

2. Viscosity

The viscosities of the coatings are measured with a Brookfield viscometer using a No. 2 spindle at 20 RPM. The results are reported in Table IV. The results show that the viscosity of the coating of the present invention, with (Formulation E) or without (Formulation D) a crosslinker, is significantly lower than the comparative coatings (Formulations A and B) without the modifiers. The lower viscosity coating is known to have better flow properties and therefore should reduce the flow patterns in non-uniformity in coat weight often seen with prior art coatings. Also, the lower viscosity coating has less tendency to form agglomerates during coating which, in turn, generally reduces the occurrence of streaks.

TABLE IV

Viscosity and Internal Bond Test Results

| Coating Formulation | Solids (%) | Viscosity (cP) | Coat Weight (#/R) | Initial Bond (oz/in.) |
|---|---|---|---|---|
| A | 23.53 | 1550 | 11.5 | 45 |
| B | 24.57 | 1325 | 11.7 | 47 |
| C | 22.92 | 1275 | 11.8 | 39 |
| D | 25.10 | 425 | 11.8 | 49 |
| E | 25.94 | 450 | 12.1 | 50 |

3. Abrasion Resistance

The abrasion resistance of the samples, both wet and dry, is measured using a CS-17 test wheel and 1,000 g. weight according to U.S. Federal Test Method No. 5306, Standard No. 191 A. The test results are shown in Table V below.

The modifiers improve both dry and wet abrasion resistance. In comparison with media in which the non-ionic surfactant, dispersing agent, and ionomer of this invention were not present, the media made with the coating composition of this invention increased dry abrasion resistance at least 50% and wet abrasion resistance at least 200%. The coating of the invention provided about 75% increase in dry abrasion resistance when no cross-linker was used (Coating Formulations A v. D) and about a 91% increase in dry abrasion resistance when a cross-linker was used (Coating Formulations B v. E). Similar comparisons of A v. D and B v. E shows surprising increases of wet abrasion resistance of 395% and 400%, respectively. The dispersing agent helps achieve a more uniform coating composition of pigment, binder, and other ingredients in the final structure. Due to a more homogeneous coating composition, and the strong interaction between ionomer, silica, and ink molecules, the coating of the invention requires more cycles for a given abrasion wheel and weight to abrade the printed surface.

4. Curl

The tendency to curl is measured by affixing coated and printed samples of pressure sensitive vinyl onto a metal panel. The samples are subjected to cycles of heating in an oven for 30 minutes (at a specified temperature [40 C, 50 C, 60 C, or 70 C]), followed by immersion in about 23 C water for 2 minutes, followed by 5 minutes of air drying at room temperature. The amount of lift of the four corners of the sample from the panel is measured and the values added to get a final reading. All samples are subjected to 12 cycles and the results are shown in Table V below.

The additives help reduce or eliminate curl, which is one of the primary problems associated with prior art coated vinyl. Laboratory tests indicated that the curl is observed only upon exposure to water followed by heat or vise-a-versa. The samples coated with the coatings of the present invention, i.e., Formulations D and E, do not curl unless heated to temperatures of about 70 C, which is a temperature not normally encountered in outdoor conditions. In contrast, the samples made with the prior art coatings, i.e., Formulations A, B and C, curled at every temperature tested. The surfactant apparently inhibits the rate of evaporation of water molecules from the topcoat and thereby reduces the stress induced during drying, which, in turn, reduces or eliminates the curl. Also, it is believed that the ionomer further reduces the stress induced curl.

TABLE V

Abrasion and Curl Test Results

| Coating | Abrasion | | Curl (1/32") | | |
|---|---|---|---|---|---|
| Formulation | Dry | Wet | 50 C | 60 C | 70 C |
| A | 97 | 20 | 0.5 | 4 | 18 |
| B | 154 | 40 | 1.5 | 4 | 17.5 |
| C | 193 | 51 | 3 | 8 | 17.5 |
| D | 170 | 79 | 0 | 0 | 4.5 |
| E | 294 | 160 | 0 | 0 | 2 |

5. Color Density

The coating according to this invention exhibits improved color density. Results of the color density measurements, obtained using a MacBeth Color Checker RD-1255 densitometer, are shown in Table VI. The improved color density may be due to the cationic ionomers interacting with the typically anionic ink molecules. The ionomer also seems to improve the retention of inks when exposed to water, probably due to some electrostatic bonding. Also, the surfactant helps reduce the surface tension of the topcoat and thereby increases the dot spread and color density.

Figure 2:
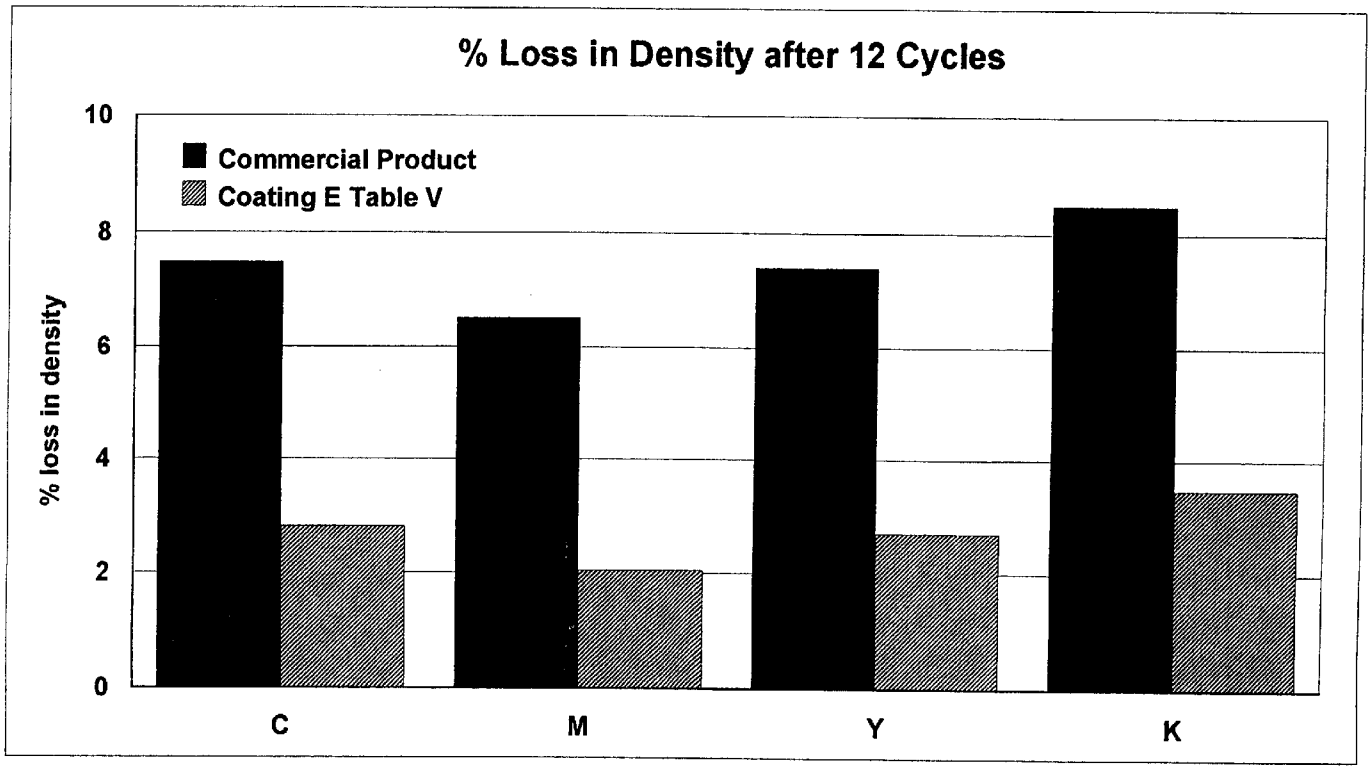
FIG. 2 is a graph showing a comparison in the percent loss of density as measured with a MacBeth Color Checker RD-1255 densitometer, after 12 cycles of immersion and drying between a known topcoat and the topcoat made with the coating composition of the invention.

Tests indicate a decrease of less than 4.0% in color density for samples printed on the coatings of this invention (i.e., Formulations D and E), even after twelve cycles of 2 minute room temperature water dips followed by 5 minutes room temperature air drying then drying for 30 minutes at temperatures up to 70 C. These results are shown in FIG. 2. In comparison, a 10–15% loss in density was observed in single water dip for printed standard vinyl (not shown in FIG. 2).

TABLE VI

Ink Absorption and Image Density

| Coating Formulation | Absorption (%) | Density K | C | M | Y | C, M, Y avg. |
|---|---|---|---|---|---|---|
| A | 225 | 0.96 | 0.76 | 0.80 | 0.74 | 0.77 |
| B | 212 | 1.03 | 0.79 | 0.87 | 0.81 | 0.82 |
| C | 200 | 0.86 | 0.69 | 0.82 | 0.84 | 0.78 |
| D | 225 | 1.03 | 0.82 | 0.94 | 0.88 | 0.89 |
| E | 212 | 1.20 | 0.95 | 1.11 | 1.03 | 1.03 |

C, M, Y, K represent the colors cyan, magenta, yellow and black, respectively.

6. Weatherability

The weatherability of images printed on ink jet recording media coated with coating Formulation A was compared to the same images printed on a recording media coating with coating Formulation E.

As explained above, these samples were air dried prior to printing with a Brady COLORPIX™ color production system using the system's pigmented outdoor ink. The samples were placed in an Atlas xenon arc weatherometer with intermittent water spray according to SAE J1960 testing protocol.

Figure 3:
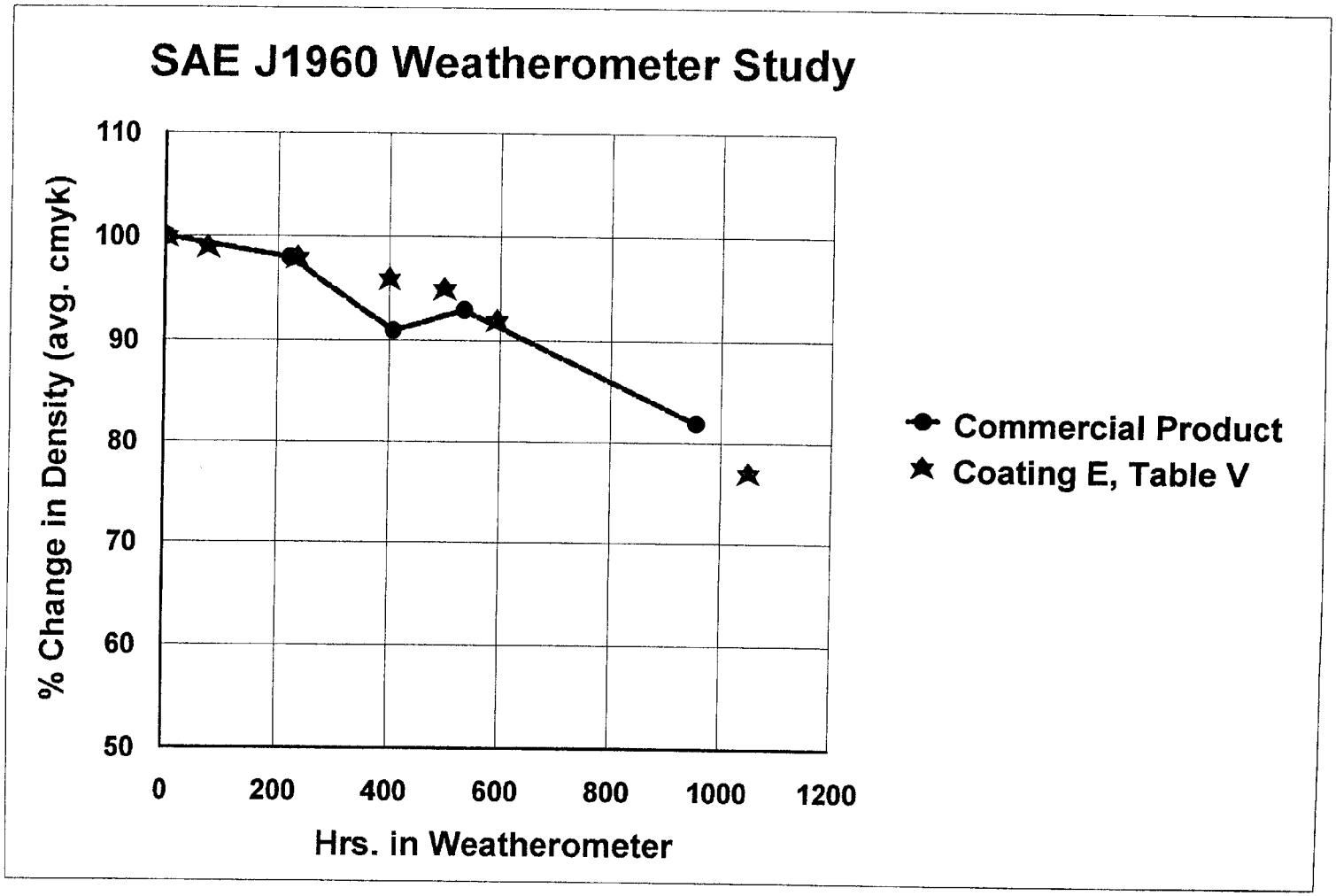
FIG. 3 is a graph showing the results of a weatherometer test comparing images printed on a topcoat made with a known coating composition versus a topcoat made with the coating composition of this invention.

The results of the weatherometer test are shown in FIG. 3. These results show nearly identical weather performance for the coating Formulation E according to this invention as with the prior art coating Formulation B. Both coatings were able to maintain at least 90% of the initial image density after 25 days in the weatherometer.

Example 2

Figure 4:
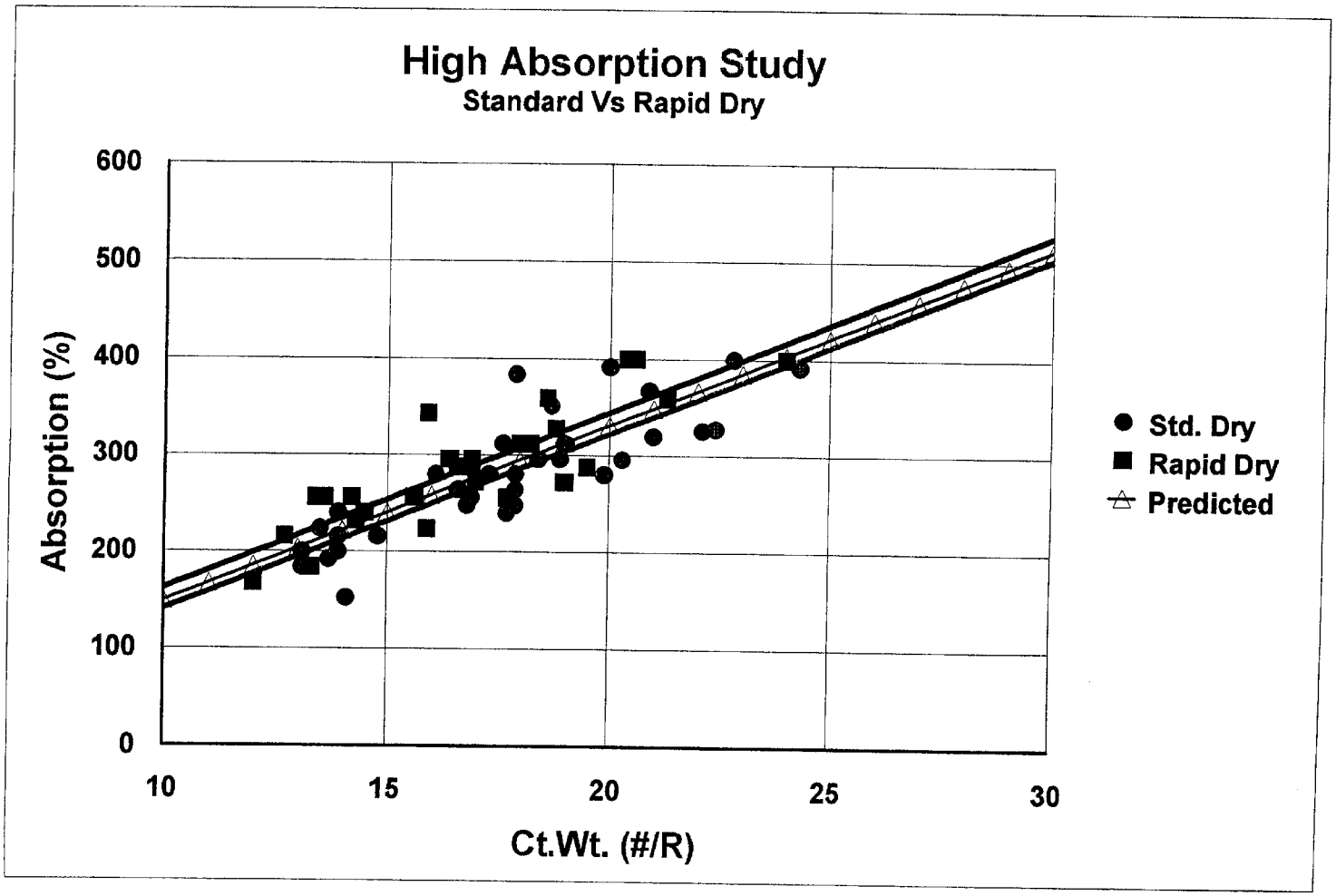
FIG. 4 is a graph showing a plot of the absorption, as measured when the ink bleed eliminated the 4 pixel wide non-printed area separating color blocks incremented from 0 to 400% ink lay down (CMYK) from a COLORPIX™ color production system using pigmented inks, of a topcoat made with the coating composition of this invention versus the coat weight of the topcoat.

Improved color gamut can be achieved by increasing the coat weight and thereby improving the absorption of the topcoat, see FIG. 4. Color gamut refers to the ability of a recording medium, or topcoat, to absorb ink of all four colors (cyan, magenta, yellow and black). The topcoat made from Formulation E exhibits absorption of about 200% at 12 #/R coat weight, and requires a coat weight of about 18#/R, or higher, to achieve more than 300% absorption. See FIG. 4.

Figure 5:
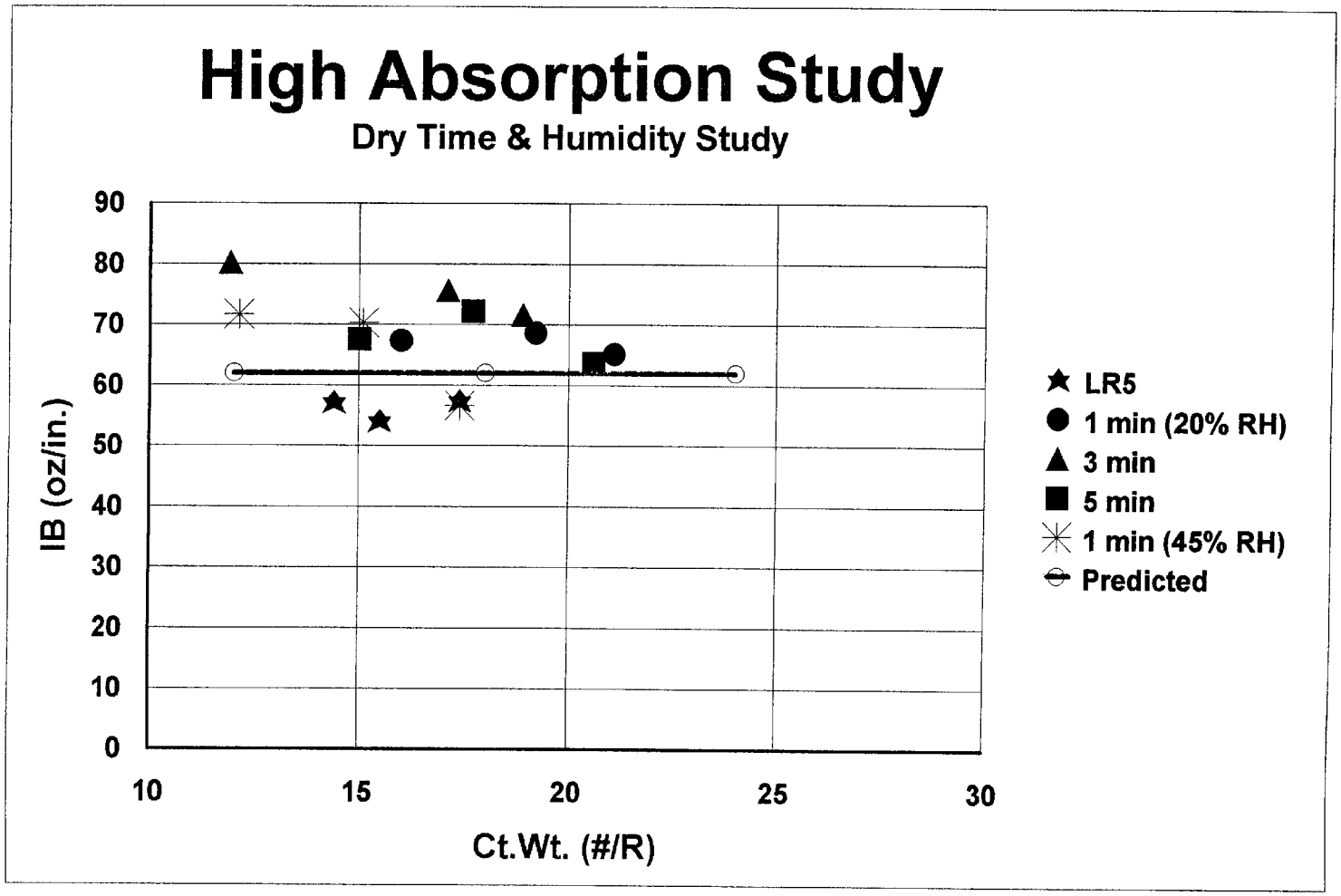
FIG. 5 is a graph showing the internal bond strength, as measured with a Thwing Albert EJA tensile tester, of different weight topcoats made with the coating composition of the current invention.

The coating Formulation E with the ionomer HS100, indicates no difference in internal bond values for samples dried under either different humidity or air dry time (see FIG. 5). Additionally, the internal bond values for the topcoat are similar across the range of coat weights from about 12 to about 21, #/R. These results indicate that the desired higher absorption can be achieved by using HS100 without affecting the internal bond under wider process conditions.

The examples shown in this specification are illustrative in nature only and should not be used to construe or limit the scope of the claims. Likewise, the theories regarding the working of the invention are also illustrative and the subject matter of the invention is not to be limited to the validity or scope of those theories.

I claim:

1. A coating composition for ink jet recording media comprising:

(a) At least one non-ionic surfactant;

(b) At least one dispersing agent;

(c) At least one ionomer;

(d) At least one polyamide binder, the polyamide binder having a surface energy of at least about 40 dyne/cm as measured by ASTM D2578-94; and (e) At least one particulate filler.

2. The coating of claim 1, wherein the non-ionic surfactant is at least one non-ionic fluorocarbon surfactant.

3. The coating of claim 2, wherein the at least one non-ionic fluorocarbon surfactant is selected from the group consisting of fluoraliphatic polymeric ester, linear perfluorinated polyethoxylated alcohol, fluorinated alkyl polyoxyethylene alcohol, fluorinated alkyl alkoxylate, and a mixture thereof.

4. The coating of claim 3, wherein the non-ionic fluorocarbon surfactant is a fluoraliphatic polymeric ester of Formula (I)

$$F(CF_2CF_2)_{2\text{-}10}(CH_2CH_2O)_{1\text{-}18}H \quad \text{(I).}$$

5. The coating of claim 4, wherein the non-ionic fluorocarbon surfactant is present in an amount ranging from about 0.10 to about 0.40 wt. %, based on the weight of the total coating solution.

6. The coating of claim 1, wherein the dispersing agent is an alkaline polyphosphate.

7. The coating of claim 6, wherein the alkaline polyphosphate is selected from the group consisting of tetrasodium pyrophosphate, sodium hexametaphosphate, sodium tripolyphosphate, disodium acid pyrophosphate, hexasodium tetra-polyphosphate, tetrasodium pyrophosphate crystals, tetrapotassium polyphosphate, and a mixture thereof.

8. The coating of claim 6, wherein the alkaline polyphosphate is tetrasodium pyrophosphate.

9. The coating of claim 6, wherein the dispersing agent is present in an amount ranging from about 0.05 to about 0.30 wt. %, based on the dry particulate filler weight.

10. The coating of claim 1, wherein the ionomer is selected from the group consisting of vinyl pyrrolidone copolymer, cationic cellulose, cationic hydroxyethylcellulose, modified polystyrene, cationic methacryolate polymer, and a mixture thereof.

11. The coating of claim 10, wherein the ionomer is a vinyl pyrrolidone copolymer.

12. The coating of claim 11, wherein the ionomer is a copolymer of vinyl pyrrolidone and methacrylaminopropyltrimethylammonium chloride.

13. The coating of claim 11, wherein the ionomer is a copolymer of vinyl pyrrolidone and dimethylaminoethylmethacrylate quatranized with diethyl sulfate.

14. The coating of claim 10, wherein the ionomer is present in an amount ranging from about 5 up to about 15 wt. %, based on the dry weight of the polyamide binder.

15. The coating of claim 1, wherein the polyamide binder is a non-cationic alcohol-soluble water-insoluble resin dissolved in an alcoholic liquid medium.

16. The coating composition of claim 15, further comprising a crosslinking agent.

17. The coating composition of claim 16, wherein the crosslinking agent is a polyfunctional aziridine.

18. The coating composition of claim 17, wherein the polyfunctional aziridine is at least one of the group consisting of trimethylolpropane-tris-(β-(aziridinyl)propionate), pentaerythritol-tris-(β-(aziridinyl)propionate), and trimethylolpropane-tris-(β-(N-methylaziridinyl) propionate).

19. The coating composition of claim 1, wherein the polyamide binder is a non-cationic water-insoluble resin dispersed in an aqueous or alcoholic liquid medium.

20. The coating composition of claim 1, wherein the particulate filler is silica.

21. The coating composition of claim 1, further comprising at least one of the group consisting of UV absorbers, hindered amine light stabilizers and antioxidants.

22. The coating composition of claim 1, wherein the coating composition has a viscosity of less than about 500 cp at a solids content of 25%, when measured with a Brookfield viscometer with a #2 spindle, at 20 RPM.

23. The coating composition of claim 2, wherein the (A) non-ionic fluorocarbon surfactant is present in an amount from about 0.10 to about 0.40 wt. %, based on the weight of the total coating solution and is selected from the group consisting of fluoraliphatic polymeric ester, linear perfluorinated polyethoxylated alcohol, fluorinated alkyl polyoxyethylene alcohol, fluorinated alkyl alkoxylate, and a mixture thereof;

(B) the dispersing agent is an alkaline polyphosphate selected from the group consisting of tetrasodium pyrophosphate, sodium hexametaphosphate, sodium tripolyphosphate, disodium acid pyrophosphate, hexasodium tetra-polyphosphate, tetrasodium pyrophosphate crystals, tetrapotassium polyphosphate, and a mixture thereof and is present in an amount from about 0.05 to about 0.30 wt. %, based on the weight of the dry particulate filler;

(C) the ionomer is selected from the group consisting of vinylpyrrolidone copolymer, cationic cellulose, cationic hydrooxyethylcellulose, modified polystyrene, cationic methacrylate polymer, and a mixture thereof and is present in an amount varying from about 5 to about 15 wt. %, based on the weight of the polyamide binder;

(D) the polyamide binder is a non-cationic alcohol soluble water insoluble resin dissolved in an alcoholic liquid medium; and (E) the particulate filler is at least one inorganic pigment selected from the group consisting of silica, calcium carbonate, precipitated silica, fumed silica, silica gel, titanium dioxide, talc, alumina, boehmite, pseudoboehmite, aluminum hydroxide, basic magnesium carbonate, amorphous magnesium carbonate, polyaluminum chloride, and zinc oxide.

24. The coating composition of claim 23, wherein the non-ionic fluorocarbon surfactant is present in an amount from about 0.22 to about 0.27 wt. %, based on the weight of the total coating solution; the dispersing agent is present in the amount ranging from about 0.08 to 0.12%, based on the dry weight of the particulate filler; and the ionomer is present in an amount ranging from 9 up to about 11 wt %, based on the dry weight of the polyamide binder.

25. The coating composition of claim 23, further comprising at least one of the group consisting of UV absorbers, hindered amine light stabilizers and antioxidants.

26. The coating composition of claim 23, further comprising a polyfunctional aziridine crosslinking agent selected from the group consisting of trimethylolpropane-tris-(β-(aziridinyl)propionate), pentaerythritol-tris-(β-(aziridinyl)propionate), and trimethylolpropane-tris-(β-(N-methylaziridinyl)propionate).

27. A recording medium for ink-jet printing obtainable by coating the coating composition of claim 1 onto a synthetic polymer film or sheet in an amount in the range from 8 to 24 $g/m^2$ and permitting the coating composition to cure.

28. A method for creating a durable ink jet image comprising applying an ink jet ink to the recording medium of claim 27.

29. The method of claim 28, wherein the ink jet ink is a pigmented ink.

* * * * *